US008232499B2

(12) United States Patent
Bush et al.

(10) Patent No.: US 8,232,499 B2
(45) Date of Patent: Jul. 31, 2012

(54) CONTACTOR ASSEMBLY FOR SWITCHING HIGH POWER TO A CIRCUIT

(75) Inventors: Bernard Bush, Santa Barbara, CA (US); Marcus Priest, Carpinteria, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 378 days.

(21) Appl. No.: 12/620,695

(22) Filed: Nov. 18, 2009

(65) Prior Publication Data

US 2011/0114602 A1 May 19, 2011

(51) Int. Cl.
*H01H 33/02* (2006.01)

(52) U.S. Cl. ..... 218/156; 218/34

(58) Field of Classification Search ..... 218/22, 218/34–40, 149–158; 335/201, 202
See application file for complete search history.

(56) References Cited

U.S. PATENT DOCUMENTS

| | | | | |
|---|---|---|---|---|
| 4,525,612 | A | 6/1985 | Kawashima | |
| 5,394,128 | A | 2/1995 | Perreira et al. | |
| 5,519,370 | A | 5/1996 | Perreira et al. | |
| 5,763,847 | A | 6/1998 | Moldovan et al. | |
| 6,064,024 | A | 5/2000 | Moldovan | |
| 6,100,491 | A | 8/2000 | Moldovan | |
| 6,163,002 | A | 12/2000 | Ahn et al. | |
| 7,262,942 | B2 | 8/2007 | Lam | |
| 7,551,050 | B2 | 6/2009 | Annis et al. | |
| 7,679,021 | B2 * | 3/2010 | Gericke et al. | 218/48 |
| 7,716,816 | B2 * | 5/2010 | Annis et al. | 29/622 |
| 7,723,634 | B2 * | 5/2010 | Annis et al. | 218/148 |
| 7,958,623 | B2 * | 6/2011 | Annis et al. | 29/622 |
| 2008/0073327 | A1 | 3/2008 | Annis et al. | |
| 2009/0094820 | A1 | 4/2009 | Annis et al. | |
| 2009/0102585 | A1 | 4/2009 | Annis et al. | |
| 2009/0114622 | A1 | 5/2009 | Bush et al. | |

FOREIGN PATENT DOCUMENTS

EP 1 686 603 8/2006

OTHER PUBLICATIONS

International Search Report, International Application No. PCT/US2010/002985, International Filing Date, Nov. 17, 2010.

* cited by examiner

*Primary Examiner* — Renee Luebke
*Assistant Examiner* — Marina Fishman

(57) ABSTRACT

A contactor assembly is adapted for switching power to a circuit having a power source. The contactor assembly includes a housing, carry contacts, and arc contacts. The housing defines an interior compartment and includes internal chamber walls that laterally extend within the compartment to define a protection chamber. The carry contacts are disposed in the protection chamber of the housing. The carry contacts include conductive bodies that protrude from the housing and are configured to close the circuit. The arc contacts are disposed in the housing outside of the protection chamber. The arc contacts include conductive bodies that protrude from the housing and are configured to close the circuit. The internal chamber walls of the housing prevent material that is expelled from one or more of the arc contacts when an electric arc emanates from one or more of the arc contacts from contaminating one or more of the carry contacts.

20 Claims, 10 Drawing Sheets

CONTACTOR ASSEMBLY FOR SWITCHING HIGH POWER TO A CIRCUIT

BACKGROUND OF THE INVENTION

The subject matter herein relates generally to switches for electric circuits, and more particularly to contactor assemblies.

Some known electric circuits include contactors that control the flow of current through the circuit. The contactors control current flow through the circuit by opening or closing a conductive pathway that extends through the contactor to correspondingly open or close the circuit.

In circuits that convey relatively high levels of direct current, electric arcs may be generated inside the contactors when the contactor switches from an open state to a closed state to close the circuit. When the contactors change from the open state to the closed state, an electric arc may radiate from the contacts in the contactor when current begins to flow through the contacts. The electric arc can be of relatively high energy. If the arc is of sufficiently high energy, the arc can damage and/or contaminate the contacts in the contactor. The arcs also can weld the contacts with one another. For example, the arcs may weld the contacts together such that the contactor cannot separate the contacts to open the circuit to which the contactor is connected.

Some known contactors that are able to withstand relatively large currents are large, heavy, and expensive to manufacture. The contactors may include relatively large contacts, actuator mechanisms, and/or arc dissipation members that are heavy and/or expensive to produce. Other smaller and/or lighter contactors are unable to withstand relatively large currents due to the significant electrical arcs. The contacts and/or arc dissipation members in these contactors are more easily damaged by the electrical arcs radiating from the contacts. Additionally, some of the contacts may be separated from one another and open the circuit when the contacts first come into contact with one another. The arc that emanates from the contacts may blow the contacts apart from one another if the arc is not dissipated rapidly.

A need exists for a smaller, lighter, and/or less expensive contactor that is able to safely turn on and off relatively large electric currents while avoiding welding, and excessive arcing damage to the contacts in the contactor.

BRIEF DESCRIPTION OF THE INVENTION

In one embodiment, a contactor assembly is provided. The contactor assembly is adapted for switching power to a circuit having a power source. The contactor assembly includes a housing, carry contacts, and arc contacts. The housing defines an interior compartment and includes internal chamber walls that laterally extend within the compartment to define a protection chamber. The carry contacts are disposed in the protection chamber of the housing. The carry contacts include conductive bodies that protrude from the housing and are configured to close the circuit. The arc contacts are disposed in the housing outside of the protection chamber. The arc contacts include conductive bodies that protrude from the housing and are configured to close the circuit. The internal chamber walls of the housing prevent material that is expelled from one or more of the arc contacts when an electric arc emanates from the one or more of the arc contacts from contaminating one or more of the carry contacts.

In another embodiment, another contactor assembly is provided. The contactor assembly includes a housing, carry contacts, arc contacts, and a magnet. The housing includes an interior compartment having opposing transverse perimeter walls and opposing internal chamber walls extending from each of the transverse perimeter walls. The carry contacts are disposed in the interior compartment between the chamber walls in the housing. The carry contacts include conductive bodies that protrude from the housing to close a circuit having a power source. The carry contacts are configured to be electrically interconnected to close the circuit. The arc contacts are disposed in the interior compartment between the transverse perimeter walls and separated from the carry contacts by the chamber walls. Each of the arc contacts is separated from the transverse perimeter walls by blowout pockets of the interior compartment. The arc contacts include conductive bodies that are configured to be electrically interconnected to close the circuit. The magnet is disposed within the housing and imparts a magnetic flux across the arc contacts. The chamber walls prevent an electric arc emanating from one or more of the arc contacts from extending to the carry contacts and the magnet directs the electric arc into the blowout pockets and away from one or more of the carry contacts when electric current is supplied by the circuit across the arc contacts.

DETAILED DESCRIPTION OF THE INVENTION

Figure 1:
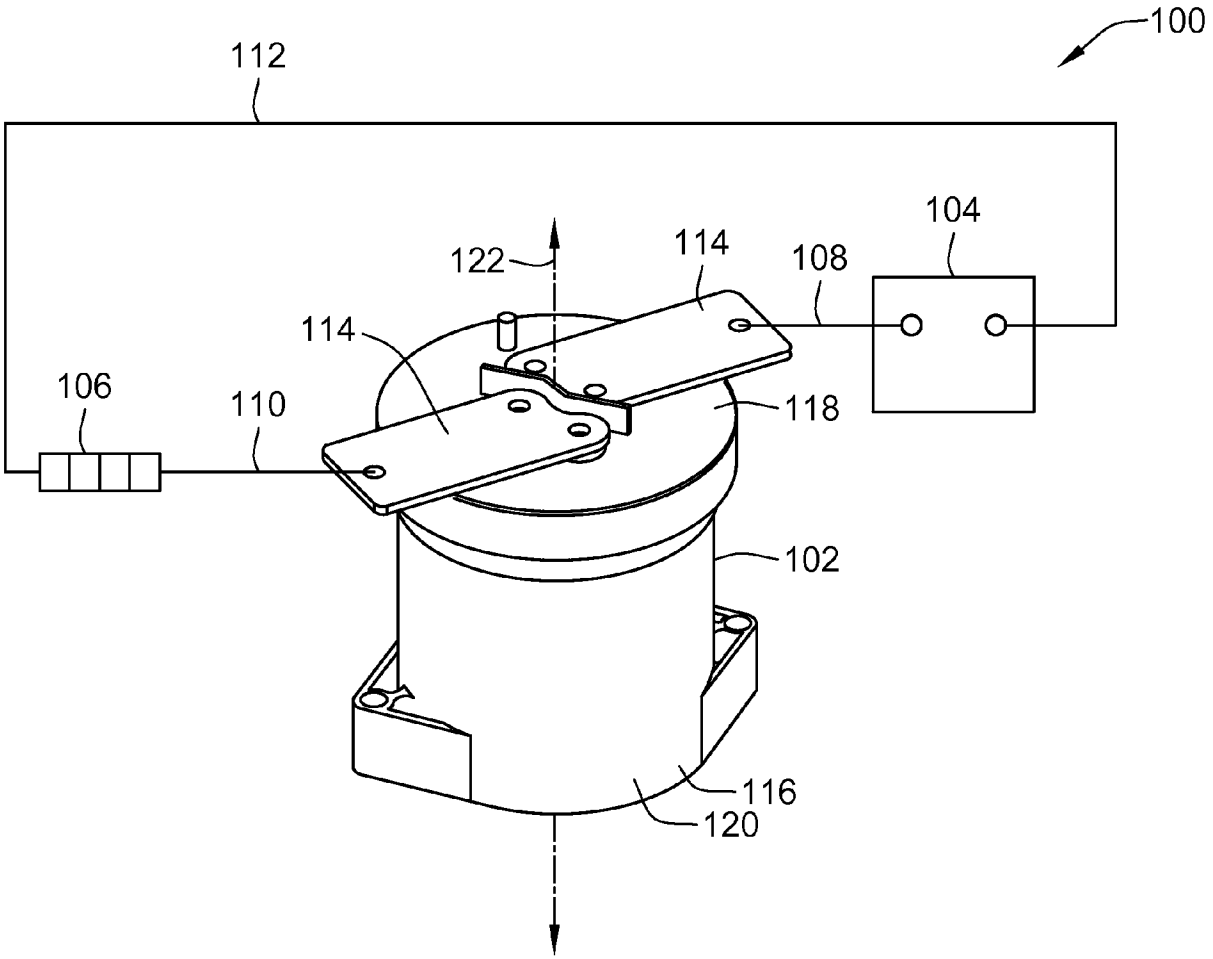
FIG. 1 is a schematic diagram of a circuit that includes a contactor assembly in accordance with one embodiment of the present disclosure.

FIG. 1 is a schematic diagram of a circuit 100 that includes a contactor assembly 102 in accordance with one embodiment of the present disclosure. The circuit 100 includes a power source 104 that is electrically coupled with one or more electrical loads 106 via conductive pathways 108, 110, 112 and the contactor assembly 102. The power source 104 may be any of a variety of systems, devices, and apparatuses that supply electric current to power the electrical load 106. For example, the power source 104 may be a battery that supplies direct current (DC) or alternating current (AC) to the electrical load 106. In one embodiment, the power source 104 is a relatively high voltage DC battery that supplies electric current to one or more electronic components of an aircraft. By way of example only, the power source 104 may supply direct current of at least approximately 270 volts and/or 6,000 amps.

The conductive pathways 108-112 may include any of a variety of conductive bodies capable of transmitting electric current. For example, the conductive pathways 108-112 may include wires, cables, bus bars, contacts, connectors, and the like. The contactor assembly 102 is a relay or switch that controls the delivery of power through the circuit 100. The contactor assembly 102 is joined with the power source 104 and the electrical load 106 by the conductive pathways 108, 110. In the illustrated embodiment, bus bars 114 couple the conductive pathways 108, 110 with the contactor assembly 102. Alternatively, a different number of bus bars 114 may be used or a different component or assembly may be used to electrically join the contactor assembly 102 with the circuit 100. The contactor assembly 102 alternates between open and closed states. In a closed state, the contactor assembly 102 provides a conductive bridge between the conductive pathways 108, 110, or between the bus bars 114, in order to close the circuit 100 and permit current to be supplied from the power source 104 to the electrical load 106. In an open state, the contactor assembly 102 removes the conductive bridge between the pathways 108, 110, or between the bus bars 114, such that the circuit 100 is opened and current cannot be supplied from the power source 104 to the electrical load 106 via the contactor assembly 102.

The contactor assembly 102 is shown in FIG. 1 as including an outer housing 116 that extends between opposite ends 118, 120 along a longitudinal axis 122. While the outer housing 116 is shown in the approximate shape of a cylindrical can, alternatively the outer housing 116 may have a different shape. The outer housing 116 may include, or be formed from, a dielectric material such as one or more polymers. In another embodiment, the outer housing 116 may include or be formed from conductive materials, such as one or more metal alloys. As described below, the contactor assembly 102 includes a set of carry contacts 202, 204 (shown in FIG. 2) and a set of arc contacts 206, 208 (shown in FIG. 2) that convey current through the contactor assembly 102. The carry and arc contacts 202-208 close and open the circuit 100. In one embodiment, when the carry and arc contacts 202-208 close the circuit 100, the arc contacts 206, 208 close the circuit 100 before the carry contacts 202, 204. The initial transfer of relatively high current that is supplied by the power source 104 across the arc contacts 206, 208 may cause the arc contacts 206, 208 to arc, or create an electric arc that extends from one or more of the arc contacts 206, 208 within the contactor assembly 102. For example, the gas or atmosphere within the contactor assembly 102 that surrounds the arc contacts 206, 208 may electrically break down and permit the electric charge surging through the arc contacts 206, 208 to jump or move across the gas or atmosphere. The arcing may produce an ongoing plasma discharge that results from current flowing through normally nonconductive media such as the gas or atmosphere. The arcing can result in a very high temperature that may be capable of melting, vaporizing, or damaging components within the contactor assembly 102, such as the carry contacts 202, 204. In accordance with one or more embodiments described here, the contactor assembly 102 includes features that direct the electric arc away from the carry contacts 202, 204 and/or dissipates the electric arc such that the electric arc does not damage or contaminate the carry contacts 206, 208.

Figure 2:
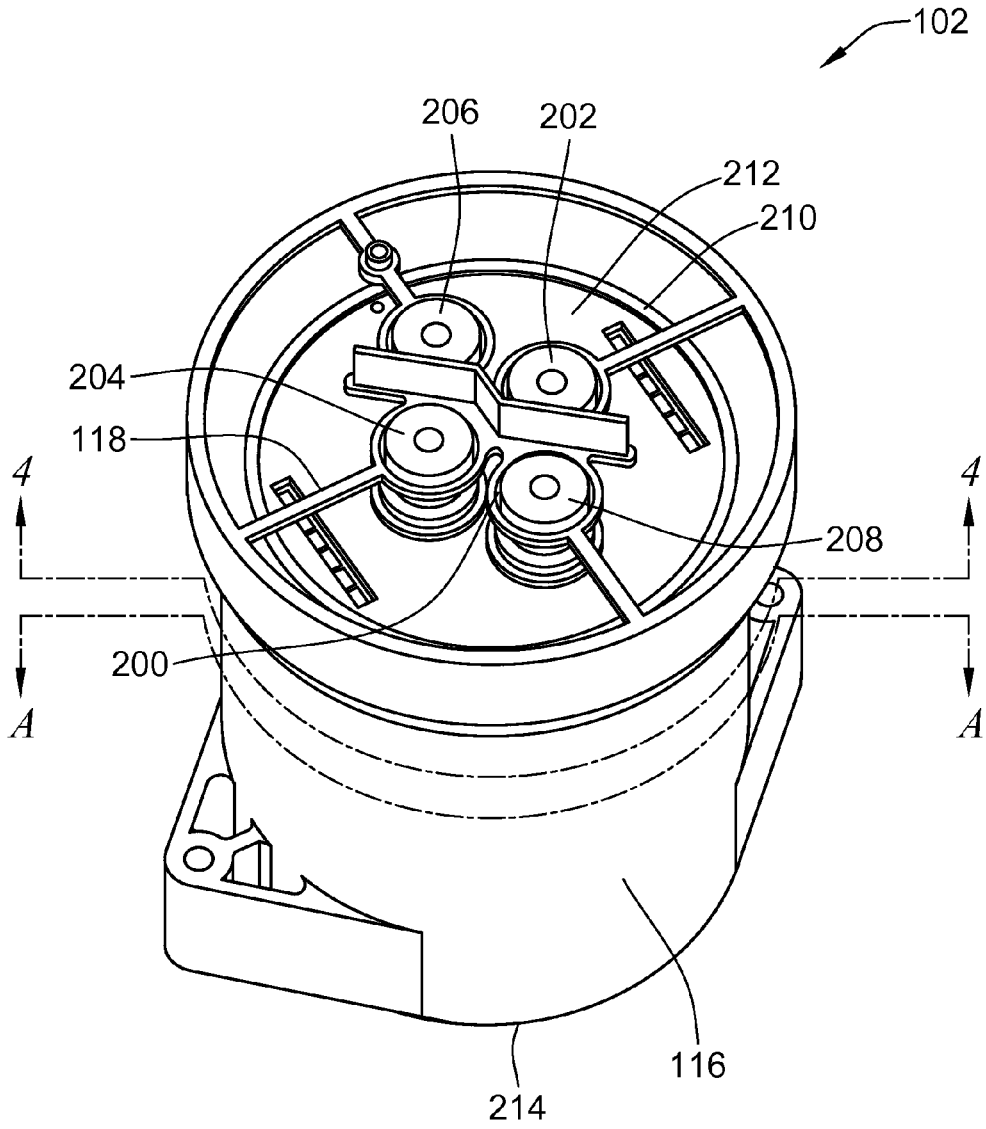
FIG. 2 is a partial cut-away view of the contactor assembly shown in FIG. 1 in accordance with one embodiment of the present disclosure.

FIG. 2 is a partial cut-away view of the contactor assembly 102 in accordance with one embodiment of the present disclosure. The contactor assembly 102 is shown with portions of the end 118 of the outer housing 116 removed. The end 118 includes several openings 200 through which the carry contacts 202, 204 and the arc contacts 206, 208 extend. The carry and arc contacts 202-208 extend through the openings 200 to mate with conductive bodies that are joined with the circuit 100 (shown in FIG. 1), such as the bus bars 114 (shown in FIG. 1). In the illustrated embodiment, the carry contact 202 and the arc contact 206 mate with one of the bus bars 114 while the carry contact 204 and the arc contact 208 mate with the other bus bar 114.

The contactor assembly 102 includes an inner housing 210 disposed within the outer housing 116. The inner housing 210 may extend between opposite ends 212, 214 along the longitudinal axis 122. As shown in FIG. 2, the carry and arc contacts 202-208 protrude through the end 212 of the inner housing 210 to be presented at the end 118 of the outer housing 116. The inner housing 210 may include, or be formed from, a dielectric material such as one or more polymers. In another embodiment, the inner housing 210 may include or be formed from conductive materials, such as one or more metal alloys.

Figure 3:
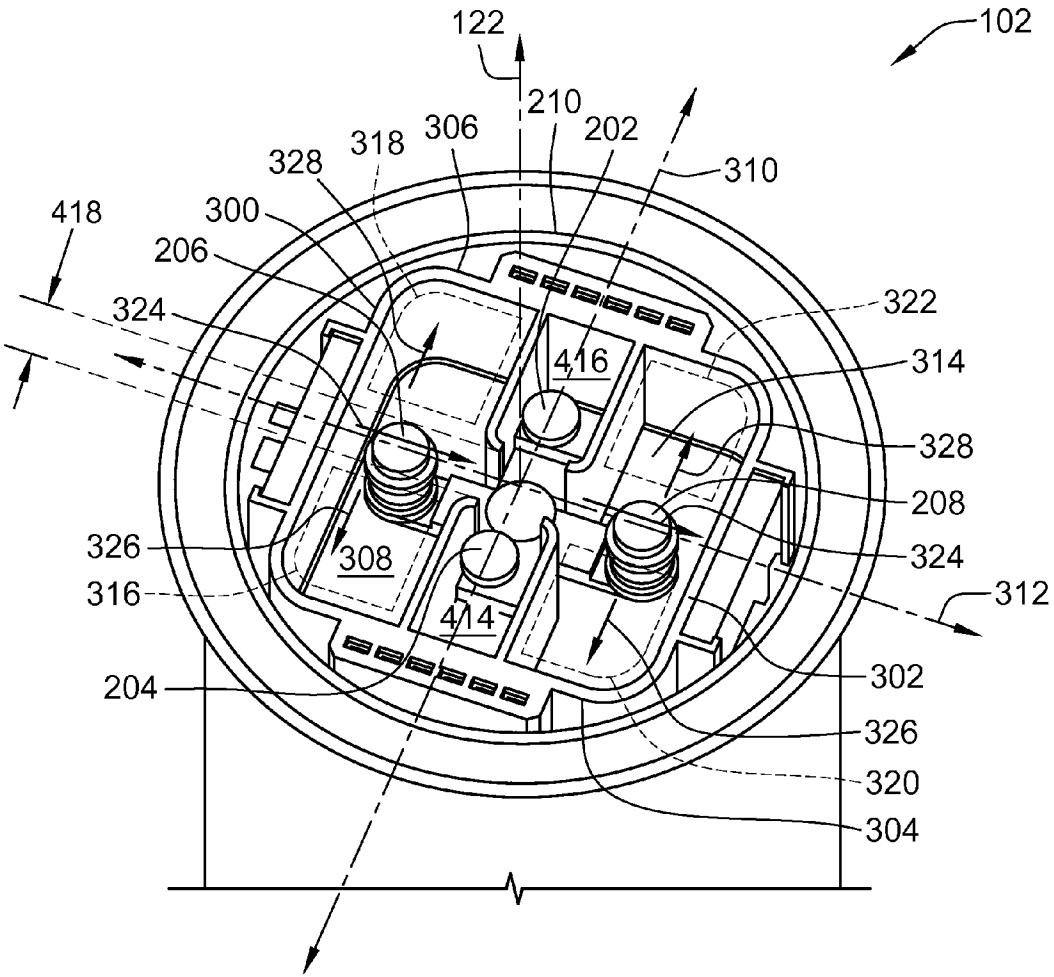
FIG. 3 is a cross-sectional view of the contactor assembly along line A-A shown in FIG. 2 in accordance with one embodiment of the present disclosure.
Figure 4:
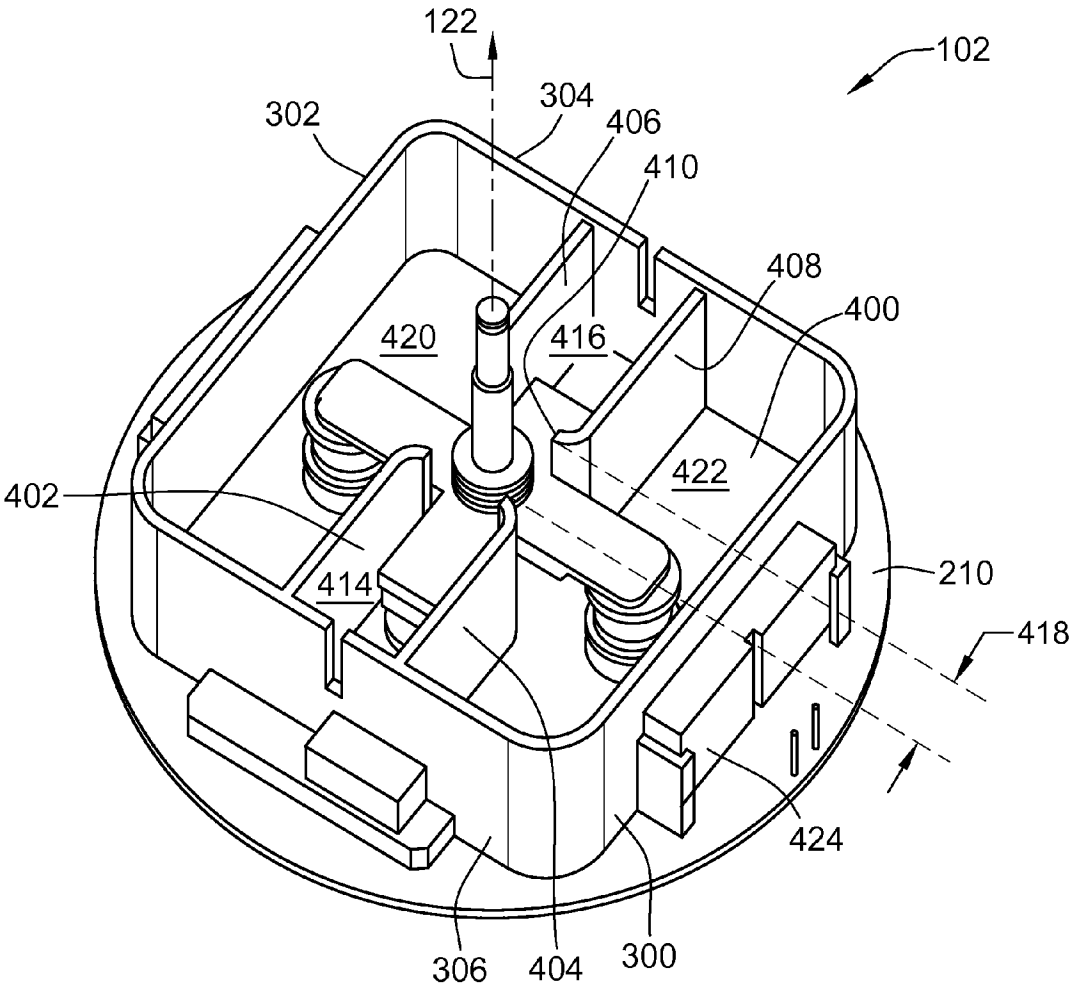
FIG. 4 is a cross-sectional view of the contactor assembly along line 4-4 shown in FIG. 2 in accordance with one embodiment of the present disclosure.

FIG. 3 is a cross-sectional view of the contactor assembly 102 along line A-A shown in FIG. 2 in accordance with one embodiment of the present disclosure. FIG. 4 is a cross-sectional view of the contactor assembly 102 along line 4-4 shown in FIG. 2 in accordance with one embodiment of the present disclosure. The outer housing 116 is removed from the view shown in FIG. 4.

The inner housing 210 includes several interior walls 300, 302, 304, 306, 314 (shown in FIG. 3), 400 (shown in FIG. 4) that define an interior compartment 308 (shown in FIG. 3) of the contactor assembly 102. For example, the interior compartment 308 may be bounded or enclosed by the interior walls 300-314, 400. The interior walls 300-314, 400 may include, or be formed from, a dielectric material such as one or more polymers. In another embodiment, the interior walls 300-314, 400 may include or be formed from conductive materials, such as one or more metal alloys.

The interior walls 300-306 may be referred to as perimeter walls and the interior walls 314, 400 may be referred to as upper and lower walls, respectively. The perimeter walls 300-306 extend along the longitudinal axis 122 between the lower wall 314 and the upper wall 400. The perimeter walls 300-306 also extend around the periphery of the interior compartment 308 (shown in FIG. 3) in lateral and transverse directions. For example, the perimeter walls 300, 302 may be referred to as lateral perimeter walls 300, 302 that extend in directions that are parallel to a lateral axis 310 (shown in FIG. 3). The perimeter walls 304, 306 may be referred to as transverse perimeter walls 304, 306 that extend in directions that are parallel to a transverse axis 312 (shown in FIG. 3). As shown in FIG. 3, the lateral perimeter walls 300, 302 oppose one another and are located on opposite sides of the interior compartment 308. The transverse perimeter walls 304, 306 oppose one another and are located on opposite sides of the interior compartment 308. The lateral perimeter walls 300, 302 laterally extend between and interconnect or intersect the transverse perimeter walls 304, 306. The transverse perimeter walls 304, 306 transversely extend between and interconnect or intersect the lateral perimeter walls 300, 302. While the perimeter walls 300-306 are shown as planar surfaces that are oriented in sets of parallel walls 300/302 and 304/306, alternatively the walls 300-306 may have different shapes and/or be oriented differently than is shown in the illustrated embodiment.

As shown in FIG. 3, the carry and arc contacts 202-208 are disposed in the interior compartment 308. The interior compartment 308 may be sealed and loaded with an inert and/or insulating gas, such as sulphur hexafluoride, nitrogen, and the like. The perimeter walls 300-306 and the upper and lower walls 314 (shown in FIG. 3), 400 (shown in FIG. 4) enclose the carry and arc contacts 202-208 so that any electric arc extending from the carry and/or arc contacts 202-208 are contained within the interior compartment 308 and do not extend out of the interior compartment 308 to damage other components of the contactor assembly 102 or circuit 100 (shown in FIG. 1).

In the illustrated embodiment, the interior compartment 308 includes internal chamber walls 402, 404, 406, 408 (shown in FIG. 4). The chamber walls 402, 404 oppose one another and extend from the transverse perimeter wall 306 toward the opposing transverse perimeter wall 304. The chamber walls 406, 408 oppose one another and extend from the transverse perimeter wall 304 toward the opposing transverse perimeter wall 306. In the illustrated embodiment, the chamber walls 402-408 extend from the transverse perimeter walls 304, 306 to outer edges 410 (shown in FIG. 4). Each of the outer edges 410 of the chamber walls 402, 404 is separated from the outer edges 410 of the chamber walls 406, 408 by a gap 418 oriented along the lateral axis 310 (shown in FIG. 3). The arc contacts 206, 208 are linearly aligned with the gaps 418 in a direction oriented along or parallel to the transverse axis 312. Alternatively, the arc contacts 206, 208 may be located other positions. While the chamber walls 402-408 do not extend from one transverse perimeter wall 304, 306 to the other transverse perimeter wall 304, 306 in the illustrated embodiment, alternatively the chamber walls 402-408 may extend from one transverse perimeter wall 304, 306 to the other transverse perimeter wall 304, 306. The chamber walls 402-408 may extend from the lower wall 314 (shown in FIG. 3) to the upper wall 400 (shown in FIG. 4). The chamber walls 402-408 may include, or be formed from, a dielectric material such as one or more polymers. In another embodiment, the chamber walls 402-408 may include or be formed from conductive materials, such as one or more metal alloys.

The chamber walls 402-408 (shown in FIG. 4) define protection chambers 414, 416 for the carry contacts 202, 204. The protection chambers 414, 416 may be separate from one another or may be referred to as a single protection chamber with the carry contacts 202, 204 disposed therein. The protection chambers 414, 416 are sections or portions of the internal compartment 308 in which the carry contacts 202, 204 are located and which do not include the arc contacts 206, 208. The protection chambers 414, 416 provide shelter to the carry contacts 202, 204 from electric arcs that may emanate from one or more of the arc contacts 206, 208. Without the protection chambers 414, 416, an electric arc emanating from an arc contact 206, 208 may travel the shortest possible distance, or a straight line, between the arc contacts 206, 208 and the carry contacts 202, 204. With the chamber walls 402-408, the straight line paths between the arc contacts 206, 208 are blocked or impeded by the chamber walls 402-408. For example, the protection chambers 414, 416 may physically shield the carry contacts 202, 204 from electric arcs radiating from the arc contacts 206, 208 when the arc contacts 206, 208 initially close the circuit 100 (shown in FIG. 1).

The chamber walls 402-408 may prevent refractory material of the arc contacts 206, 208 from contaminating the carry contacts 202, 204. For example, refractory material from the arc contacts 206, 208 may be expelled from the arc contacts 206, 208 by arcs that emanate from the arc contacts 206, 208. The chamber walls 402-408 block and prevent this material from reaching and contaminating the carry contacts 202, 204. Contamination of the carry contacts 202, 204 with refractory material from the arc contacts 206, 208 may increase the electrical resistance of the carry contacts 202, 204. The chamber walls 402-408 may isolate the positive and negative sets of carry and arc contacts 202, 204, 206, 208 to extinguish arc emanating from the arc contacts 206, 208. For example, when the circuit 100 (shown in FIG. 1) is closed by the arc contacts 206, 208, the arc contact 206 and the carry contact 202 may be joined with the positive terminal of the power source 104 (shown in FIG. 1) while the arc contact 208 and the carry contact 204 are joined with the negative terminal. Alternatively, the arc contact 206 and the carry contact 202 may be joined with the negative terminal of the power source 104 and the arc contact 208 and the carry contact 204 are joined with the positive terminal. In order to dissipate the arc, the chamber walls 402-408 may block passage of the arc from the arc contact 206, 208 that is joined with one of the terminals of the power source 104 to the arc contact 206, 208 or carry contact 202, 204 that is coupled with the other terminal of the power source 104. The chamber walls 402-408 also may provide additional shielding to the perimeter walls 300-306 from material expelled from the carry and/or arc contacts 202-208. For example, conductive material from the contacts 202-208 may be expelled by arcs emanating from the arc contacts 206, 208. The chamber walls 402-408 may block this material from reaching and coating the perimeter walls 300-306. Preventing the perimeter walls 300-306 from being coated by a conductive material expelled from the contacts 202-208 may assist in dissipating the arcs emanating from the arc contacts 206, 208 as the arcs do not have large conductive coatings on the perimeter walls 300-306 to extend toward.

The arc contacts 206, 208 are located outside of the protection chambers 414, 416. In the illustrated embodiment, each of the arc contacts 206, 208 is located approximately equidistant from each of the opposing transverse perimeter walls 304, 306. The electric arcs coming from the arc contacts 206, 208 may blocked from extending to the carry contacts 202, 204 and damaging or contaminating the carry contacts 202, 204. In one embodiment, the chamber walls 402-408 divert or physically direct the electric arcs emanating from the arc contacts 206, 208 away from the carry contacts 202, 204. Providing the chamber walls 402-408 to block or impede transmission of an electric arc from one or more arc contacts 206, 208 to one or more of the carry contacts 202, 204 may require relatively small increases in the cost, complexity, and/or manufacture of the contactor assembly 102. For example, fabricating the chamber walls 402-408 may be less expensive and require the addition of components than other methods and ways for preventing the transmission of electric arcs between the arc contacts 206, 208 and the carry contacts 202, 204.

As shown in FIG. 4, the arc contacts 206, 208 are located in arc dissipation chambers 420, 422. The arc dissipation chambers 420, 422 are subsets or sections of the internal compartment 308 that do not include the protection chambers 414, 416 or the carry contacts 202, 204. In the illustrated embodiment, the total volume or space of the internal compartment 308 is divided among the arc dissipation chambers 420, 422 and the protection chambers 414, 416 without any other chambers or separate sections being provided. Alternatively, one or more other chambers, compartments, and the like may be provided. The arc dissipation chamber 420 extends between the transverse perimeter walls 304, 306 in a direction along or parallel to the lateral axis 310 (shown in FIG. 3) and between the lateral perimeter wall 302 and the chamber walls 402, 406 in a direction along or parallel to the transverse axis 312 (shown in FIG. 3). For example, the arc dissipation chamber 420 may extend from the lateral perimeter wall 302 to a plane defined by the chamber walls 402, 406 that is parallel to the longitudinal axis 122 and the lateral axis 310. The arc dissipation chamber 422 extends between the transverse perimeter walls 304, 306 in a direction along or parallel to the lateral axis 310 and between the lateral perimeter wall 300 and the chamber walls 404, 408 in a direction along or parallel to the transverse axis 312. The arc dissipation chamber 422 may extend from the lateral perimeter wall 300 to a plane defined by the chamber walls 404, 408 that is parallel to the longitudinal axis 122 and the lateral axis 310.

The arc dissipation chambers 420, 422 (shown in FIG. 4) include blowout pockets 316, 318, 320, 322 (shown in FIG. 3) on opposite sides of each arc contact 206, 208. The blowout pockets 316-322 are sections or portions of the volume encompassed by the arc dissipation chambers 420, 422 that extend between the arc contacts 206, 208 and the corresponding perimeter walls 300-306 from the lower wall 314 (shown in FIG. 3) to the upper wall 400 (shown in FIG. 4). For example, the blowout pocket 316 includes the space inside the arc dissipation chamber 422 that is bounded by the upper and lower walls 400, 314, the lateral perimeter wall 300, the transverse perimeter wall 304, and the arc contact 206. The blowout pocket 318 includes the space inside the arc dissipation chamber 422 that is bounded by the upper and lower walls 400, 314, the lateral perimeter wall 300, the transverse perimeter wall 306, and the arc contact 206. The blowout pocket 320 includes the space inside the arc dissipation chamber 420 that is bounded by the upper and lower walls 400, 314, the lateral perimeter wall 302, the transverse perimeter wall 304, and the arc contact 208. The blowout pocket 322 includes the space inside the arc dissipation chamber 420 that is bounded by the upper and lower walls 400, 314, the lateral perimeter wall 302, the transverse perimeter wall 306, and the arc contact 208. The arc contacts 206, 208 may be considered to provide a boundary to the blowout pockets 316-322 in that the location of the arc contacts 206, 208 shown in FIGS. 3 and 4 may be treated as a plane extending along the longitudinal and transverse axes 122, 312. This plane may be considered one of the boundaries of the blowout pockets 316-322.

The blowout pockets 316-322 (shown in FIG. 3) provide space or volume for the electric arc radiating from the arc contacts 206, 208 to dissipate, or "blow out." For example, an electric arc emanating from the arc contact 206 may be directed away from the carry contacts 202, 204 by the chamber walls 402-408 (shown in FIG. 4) and into one or more of the blowout pockets 316, 318 to contain and extinguish the electric arc.

In the illustrated embodiment, magnets 424 are provided on opposite sides of the interior compartment 308 (shown in FIG. 3). For example, permanent magnets 424 may be located outside of the interior compartment 308 alongside or adjacent to the lateral perimeter walls 300, 302. Alternatively, the magnets 424 may be electromagnets or other source of a magnetic flux and/or the magnets 424 may be located elsewhere in the contactor assembly 102. The magnets 424 create magnetic flux or a magnetic field that extends across or encompasses the arc contacts 206, 208. For example, the magnetic polarity of the magnets 424 may be aligned with one another such that magnetic flux or a magnetic field is generated extending from magnetic south to magnetic north generally along the direction of arrows 324. The magnetic flux from the magnets 424 may laterally direct electric arcs radiating from one or more of the arc contacts 206, 208 into the blowout pockets 316-322. For example, the magnetic flux or field created by the magnets 424 may direct the electric arc away from the carry contacts 202, 204 and thereby increase the effective distance that the electric arc needs to travel in order to propagate or travel from the arc contacts 206, 208 to one or more of the carry contacts 202, 204. The magnetic flux "blows" the arc to one side or the other of the arc contacts 206, 208 approximately along one or more opposing directions 326, 328. The direction 326, 328 in which the arc is blown or directed depends on the polarity of the current flowing through the arc. Without the magnetic flux, the electric arc typically would travel the shortest possible distance between the arc contacts 206, 208 and the carry contacts 202, 204, which is a straight line. With the magnetic flux, the flux directs the path of the arc to approximate a parabola, thereby effectively increasing the distance that the arc must travel. The conditions conducive to arcing may be diminished by the applied flux.

Figure 5:
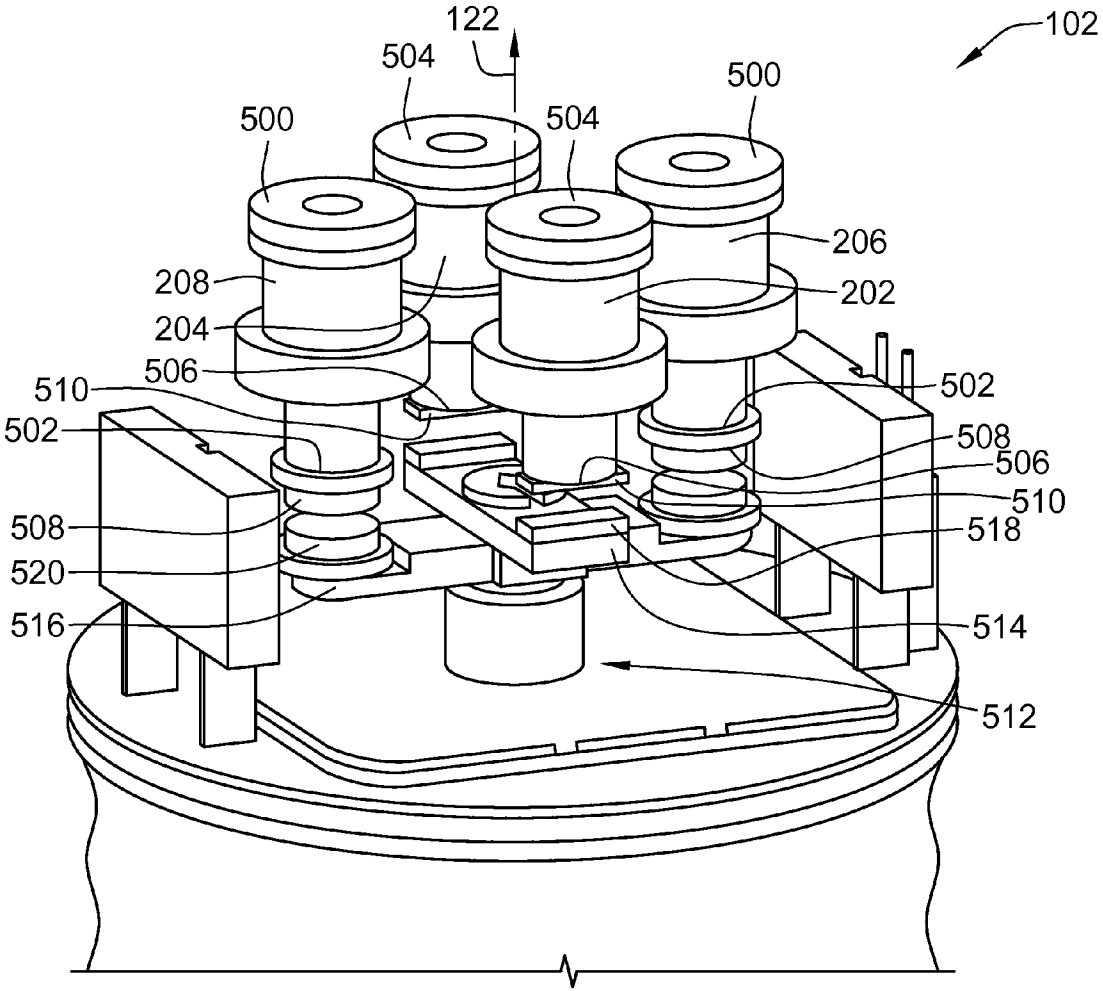
FIG. 5 is a cut away view of the contactor assembly shown in FIG. 1 in accordance with one embodiment of the present disclosure.

FIG. 5 is a cut away view of the contactor assembly 102 in accordance with one embodiment of the present disclosure. The contactor assembly 102 is shown in FIG. 5 with the outer and inner housings 116 (shown in FIG. 1), 210 (shown in FIG. 2) removed. The arc contacts 206, 208 are elongated bodies that extend between mating ends 500 and engagement ends 502. The carry contacts 202, 204 are elongated bodies that extend between mating ends 504 and engagement ends 506. The mating ends 500, 504 couple with the circuit 100 (shown in FIG. 1) to electrically couple the contactor assembly 102 with the circuit 100. For example, the mating ends 500, 504 may be joined with the bus bars 114 (shown in FIG. 1). In the illustrated embodiment, the engagement ends 502, 506 include conductive pads 508, 510. The conductive pads 508, 510 include, or are formed from, a conductive material such as one or more metals or metal alloys. The conductive pads 508 of the arc contacts 206, 208 may include or be formed of a different material than the conductive pads 510 of the carry contacts 202, 204. Alternatively, the conductive pads 508, 510 may include or be formed of the same materials. The conductive pads 508 may be formed from a metal or metal alloy that more resistant to heat and/or wear than the material(s) from which the conductive pads 510 are formed. For example, the conductive pads 508 may be formed from a refractory metal or refractory metal alloy, such as titanium (Ti), vanadium (V), chromium (Cr), zirconium (Zr), niobium (Nb), molybdenum (Mo), hafnium (Hf), tantalum (Ta), tungsten (W), or rhenium (Re). Alternatively, the conductive pads 508 may be formed from a different conductive material. The conductive pads 510 may be formed from a metal or metal alloy that is more electrically conductive than the material(s) from which the conductive pads 508 are formed. By way of example only, the conductive pads 510 may be formed from a silver (Ag) alloy. The use of a silver alloy may prevent the conductive pads 510 from welding to conductive pads 518 of an actuator subassembly 512.

The actuator subassembly 512 is disposed within the outer housing 116 (shown in FIG. 1) between the end 120 (shown in FIG. 1) of the outer housing 116 and the internal compartment 308 (shown in FIG. 3) of the inner housing 210 (shown in FIG. 2). The actuator subassembly 512 moves along or in directions parallel to the longitudinal axis 122 to electrically couple the arc contacts 206, 208 with one another and the carry contacts 202, 204 with one another. The actuator assembly 512 includes two coupling members 514, 516 that are transversely oriented with respect to one another. For example, the coupling members 514, 516 may be shaped as elongated bars that lie across one another. The coupling members 514, 516 include, or are formed from, a conductive material such as one or more metals or metal alloys.

The coupling member 514 includes conductive pads 518 on opposite ends of the coupling member 514. The coupling member 516 includes conductive pads 520 on opposite ends of the coupling member 516. The conductive pads 518 may include or be formed from the same material(s) as the conductive pads 510 of the carry contacts 202, 204. Alternatively, the materials used to form the conductive pads 510, 518 may differ. The conductive pads 520 may include or be formed from the same material(s) as the conductive pads 508 of the arc contacts 206, 208. Alternatively, the materials of the conductive pads 508, 520 may differ.

The actuator subassembly 512 moves in opposing directions along the longitudinal axis 122 to move the coupling members 514, 516 toward the carry and arc contacts 202-208 and away from the carry and arc contacts 202-208. For example, the actuator subassembly 512 may move toward the engagement ends 502, 506 of the contacts 202-208 to lift the coupling members 514, 516 toward the engagement ends 502, 506. The actuator subassembly 512 moves the coupling members 514, 516 upward to mate the conductive pads 518 of the coupling member 514 with the conductive pads 510 of the carry contacts 202, 204 and to mate the conductive pads 520 of the coupling member 516 with the conductive pads 508 of the arc contacts 206, 208. The conductive pads 508, 510, 518, 520, contacts 202-208, coupling members 514, 516, and the like, may be sized and dimensioned such that the coupling member 516 mates with the arc contacts 206, 208 prior to the coupling member 514 mating with the carry contacts 202, 204. For example, the conductive pads 508, 520 of the arc contacts 206, 208 and the coupling member 516 may be larger than the conductive pads 510, 518 of the carry contacts 202, 204 and the coupling member 514 such that the conductive pads 508, 520 engage one another before the conductive pads 510, 518 engage one another.

The mating of the coupling member 516 with the arc contacts 206, 208 prior to the mating of the coupling member 514 with the carry contacts 202, 204 causes the arc contacts 206, 208 and the actuator subassembly 512 to close the circuit 100 (shown in FIG. 1) before the actuator subassembly 512 electrically couples the carry contacts 202, 204. For example, the current supplied by the power source 104 (shown in FIG. 1) may pass through the arc contacts 206, 208 of the contactor assembly 102 prior to passing through the carry contacts 202, 204. As a result, the initial passage of the current through the arc contacts 206, 208 may cause any electric arcs that will be formed when the circuit 100 is initially closed to propagate from the arc contacts 206, 208. Once the arc contacts 206, 208 have closed the circuit 100, the current may also pass across the carry contacts 202, 204 via the actuator subassembly 512. In the illustrated embodiment, the coupling members 514, 516 join the contacts 202-208 with one another such that current may flow through the contacts 202-208 and across the actuator subassembly 512 in either direction. The mating and unmating of the actuator subassembly 512 with the contacts 202-208 is shown and described below in connection with one embodiment of the present disclosure.

Figure 6:
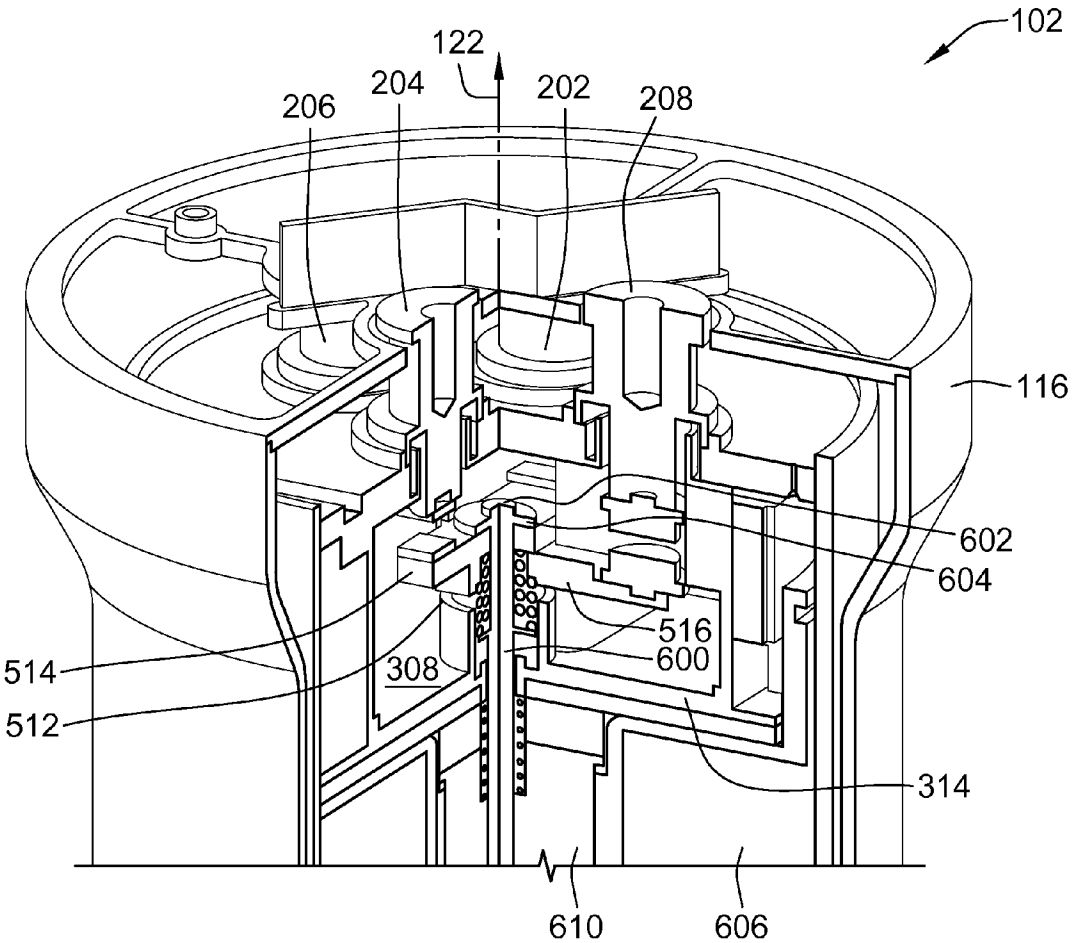
FIG. 6 is a partial cut away view of the contactor subassembly shown in FIG. 1 in an open state in accordance with one embodiment of the present disclosure.

FIG. 6 is a partial cut away view of the contactor subassembly 102 in an open state in accordance with one embodiment of the present disclosure. The actuator subassembly 512 includes an elongated plunger 600 that is oriented along the longitudinal axis 122. The coupling members 514, 516 are joined to the plunger 600 at one end 602. A clip 604 is joined with the end 602 to prevent removal of the coupling members 514, 516 from the plunger 600. The clip 604 may be a washer, fastener, or other coupling component that prevents the coupling members 514, 516 from sliding off of the end 602 of the plunger 600.

In the illustrated embodiment, the contactor assembly 102 is in an open state because the actuator subassembly 512 is decoupled from the carry and arc contacts 202-208. The actuator subassembly 512 is separated from the contacts 202-208 such that neither of the coupling members 514, 516 interconnect or electrically join the carry contacts 202, 204 or the arc contacts 206, 208 with one another. As a result, current cannot pass across the arc contacts 206, 208 or the carry contacts 202, 204.

The actuator subassembly 512 includes a magnetized body 610 coupled to an end 612 (shown in FIG. 7) of the plunger 600 that is opposite of the end 602. The body 610 may include a permanent magnet that generates a magnetic field or flux oriented along the longitudinal axis 122. The contactor assembly 102 includes a coil body 606 that encircles the body 610 between the end 120 (shown in FIG. 1) of the outer housing 116 and the lower wall 314 of the interior compartment 308. The coil body 606 may be used as an electromagnet to drive the magnetic body 610 of the plunger 600 along the longitudinal axis 122. For example, the coil body 606 may include conductive wires or other components that encircle the magnet body 610. An electric current may be applied to the coil body 606 to create a magnetic field that is oriented along the longitudinal axis 122. Depending on the direction of the current passing through the coil body 606, the magnetic field induced by the coil body 606 may have magnetic north oriented upward toward the end 118 of the outer housing 116 or downward toward the end 120.

In order to drive the actuator subassembly 512 toward the contacts 202-208, the coil body 606 is energized to create a magnetic field along the longitudinal axis 122. The magnetic field may move the magnet body 610 of the actuator assembly 512 toward the contacts 202-208 along the longitudinal axis 122. In the illustrated embodiment, a plunger spring 608 extends between the magnet body 610 and the lower wall 314 of the internal compartment 308. The plunger spring 608 exerts a force on the plunger 600 in a downward direction toward the end 120 of the outer housing 116. The force exerted by the plunger spring 608 prevents the actuator subassembly 512 from moving toward and mating with the contacts 202-208 without the creation of a magnetic field by the coil body 606. The magnetic field generated by the coil body 606 is sufficiently large or strong so as to overcome the force exerted on the plunger 600 by the plunger spring 608 and drive the plunger 600 and the actuator subassembly 512 toward the contacts 202-208.

Figure 7:
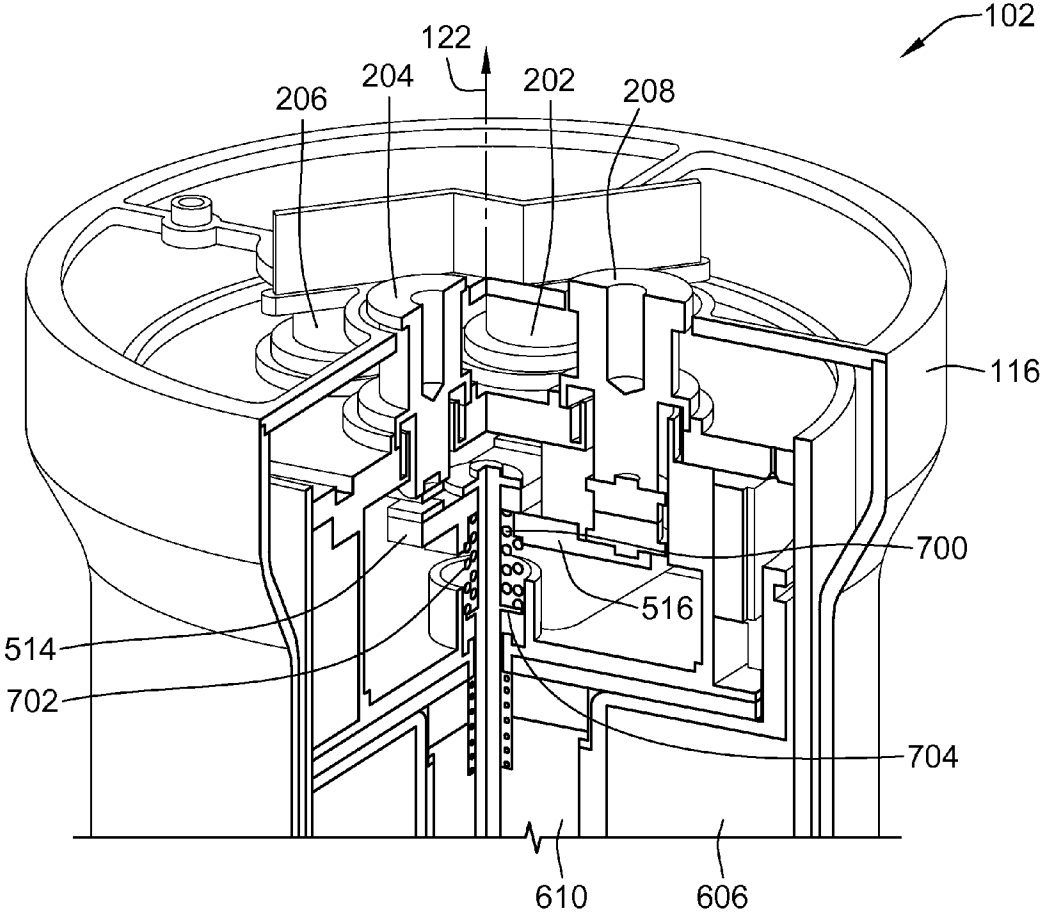
FIG. 7 is a partial cut away view of the contactor assembly shown in FIG. 1 in a partially closed state in accordance with one embodiment of the present disclosure.

FIG. 7 is a partial cut away view of the contactor assembly 102 in a partially closed state in accordance with one embodiment of the present disclosure. In the partially closed state shown in FIG. 7, the actuator subassembly 512 has moved within the contactor assembly 102 along the longitudinal axis 122 sufficiently far that the coupling member 516 has mated with the arc contacts 206, 208, but has not advanced sufficiently far to mate the coupling member 514 with the carry contacts 202, 204. As a result, the actuator subassembly 512 has electrically coupled the arc contacts 206, 208 and closed the circuit 100 (shown in FIG. 1) across the arc contacts 206, 208. Conversely, the carry contacts 202, 204 remain decoupled from one another such that current cannot pass across the carry contacts 202, 204. Once the actuator subassembly 512 closes the circuit 100 across the arc contacts 206, 208, current may pass through the contactor assembly 102 via the arc contacts 206, 208. The initial surge of current through the contactor assembly 102 may create an electrical arc emanating from one or more of the arc contacts 206, 208. As described above, the contactor assembly 102 prevents the arcs from passing from the arc contacts 206, 208 to the carry contacts 202, 204.

In the illustrated embodiment, the actuator subassembly 512 includes inner and outer springs 700, 702. The springs 700, 702 are concentric with one another and extend around the plunger 600 between the coupling members 514, 516 and a plate 704 that radially extends from the plunger 600 above the magnetic body 610. The inner spring 700 extends from the plate 704 to the coupling member 514. The outer spring 702 extends from the plate 704 to the coupling member 516. Once the actuator subassembly 512 is driven along the longitudinal axis 122 to mate the coupling member 516 with the arc contacts 206, 208, continued movement of the actuator subassembly 512 along the longitudinal axis 122 may compress the outer spring 702 between the coupling member 516 and the plate 704.

Figure 8:
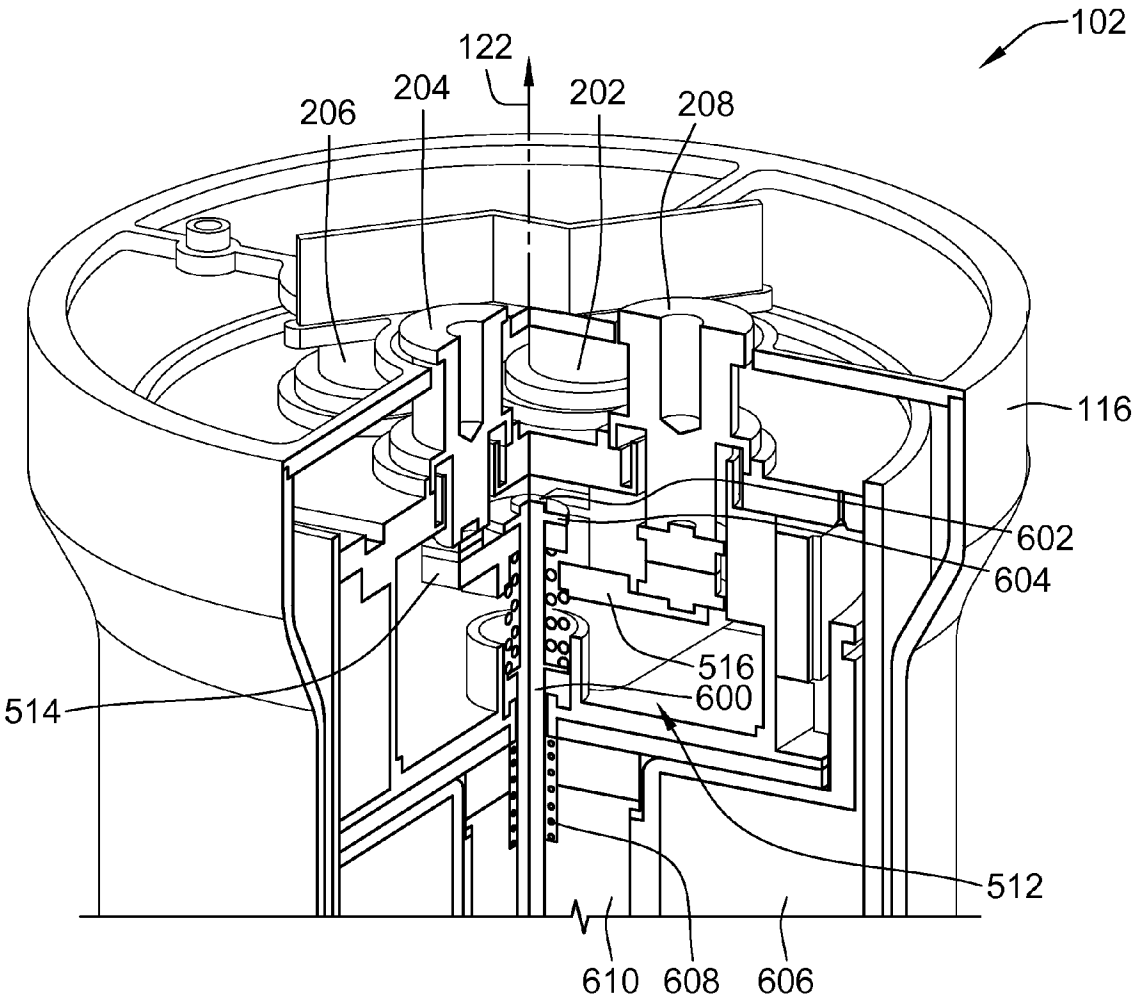
FIG. 8 is a partial cut away view of the contactor assembly shown in FIG. 1 in a closed state in accordance with one embodiment of the present disclosure.

FIG. 8 is a partial cut away view of the contactor assembly 102 in a closed state in accordance with one embodiment of the present disclosure. In the closed state shown in FIG. 8, the actuator subassembly 512 has moved within the contactor assembly 102 along the longitudinal axis 122 sufficiently far that the coupling member 516 is mated with the arc contacts 206, 208 and the coupling member 514 is mated with the carry contacts 202, 204. As a result, the actuator subassembly 512 has electrically coupled the arc contacts 206, 208 and electrically coupled the carry contacts 202, 204 to close the circuit 100 (shown in FIG. 1) across both the arc contacts 206, 208 and the carry contacts 202, 204. As a result, the current passing through the circuit 100 may propagate through the contactor assembly 102 across or through all of the contacts 202-208.

In one embodiment, the plunger 600 may continue to move along the longitudinal axis 122 toward the contacts 202-208 after the coupling members 514, 516 mate with the contacts 202-208 such that the end 602 and the clip 604 separate from the coupling member 514. For example, the clip 604 may be suspended above and separated from the coupling member 514. In order to open the circuit 100 (shown in FIG. 1), the actuator subassembly 512 may move in an opposite direction along the longitudinal axis 122. For example, the actuator subassembly 512 may move along the longitudinal axis 122 toward the end 120 (shown in FIG. 1) of the contactor assembly 102. The actuator subassembly 512 may move toward the end 120 by reducing the magnitude of the current passing through the coil body 606, eliminating the passing of current through the coil body 606, or reversing the direction of current passing through the coil body 606. For example, the magnitude of the current may be reduced or eliminated such that the compressed plunger spring 608 drives the plunger 600 and the actuator subassembly 512 along the longitudinal axis 122 toward the end 120. In another example, the direction in which the current passes through the coil body 606 may be reversed such that the direction or orientation of the magnetic flux or field generated by the coil body 606 is reversed. The reversed magnetic flux may cause the magnet body 610 to be driven toward the end 120.

Figure 9:
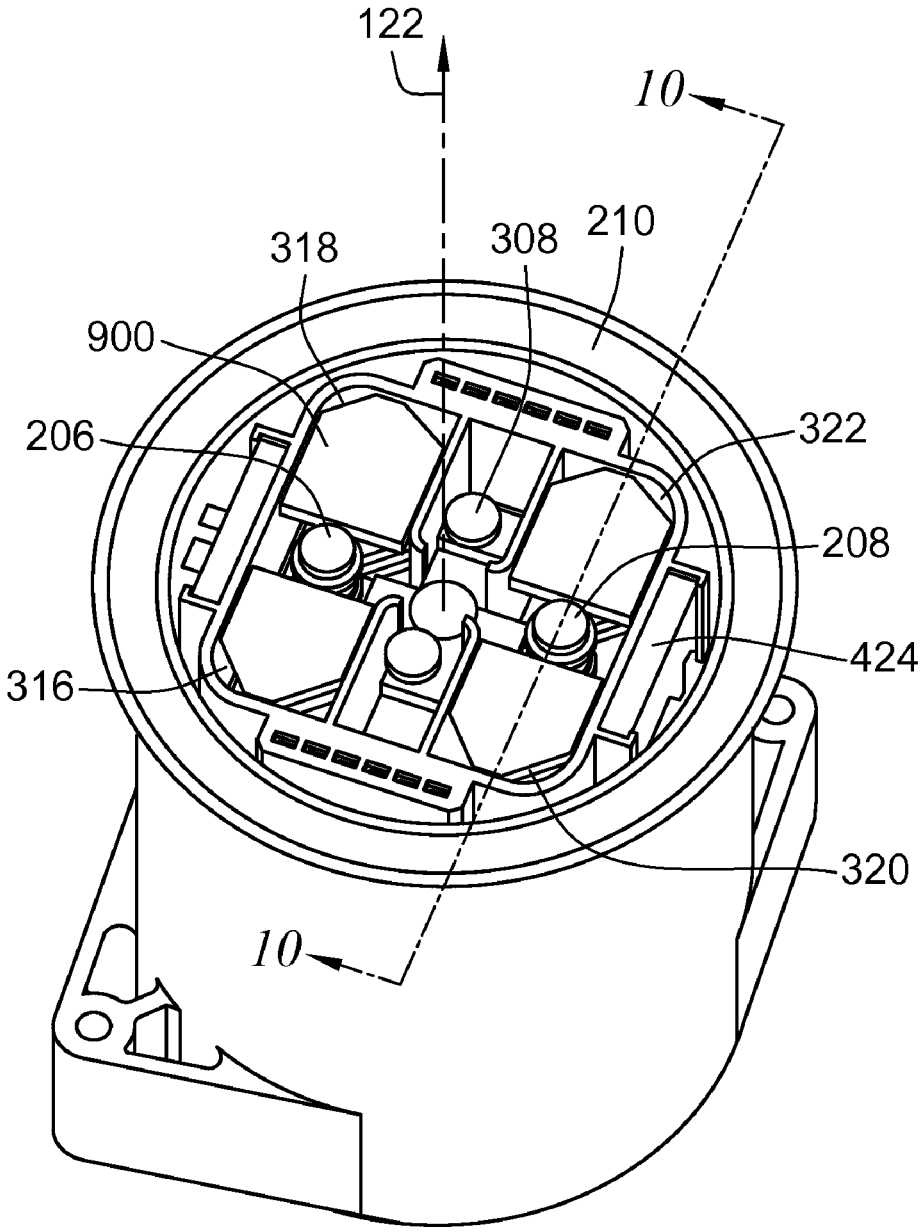
FIG. 9 is a cross-sectional view of the contactor assembly shown in FIG. 1 along line A-A in accordance with another embodiment of the present disclosure.
Figure 10:
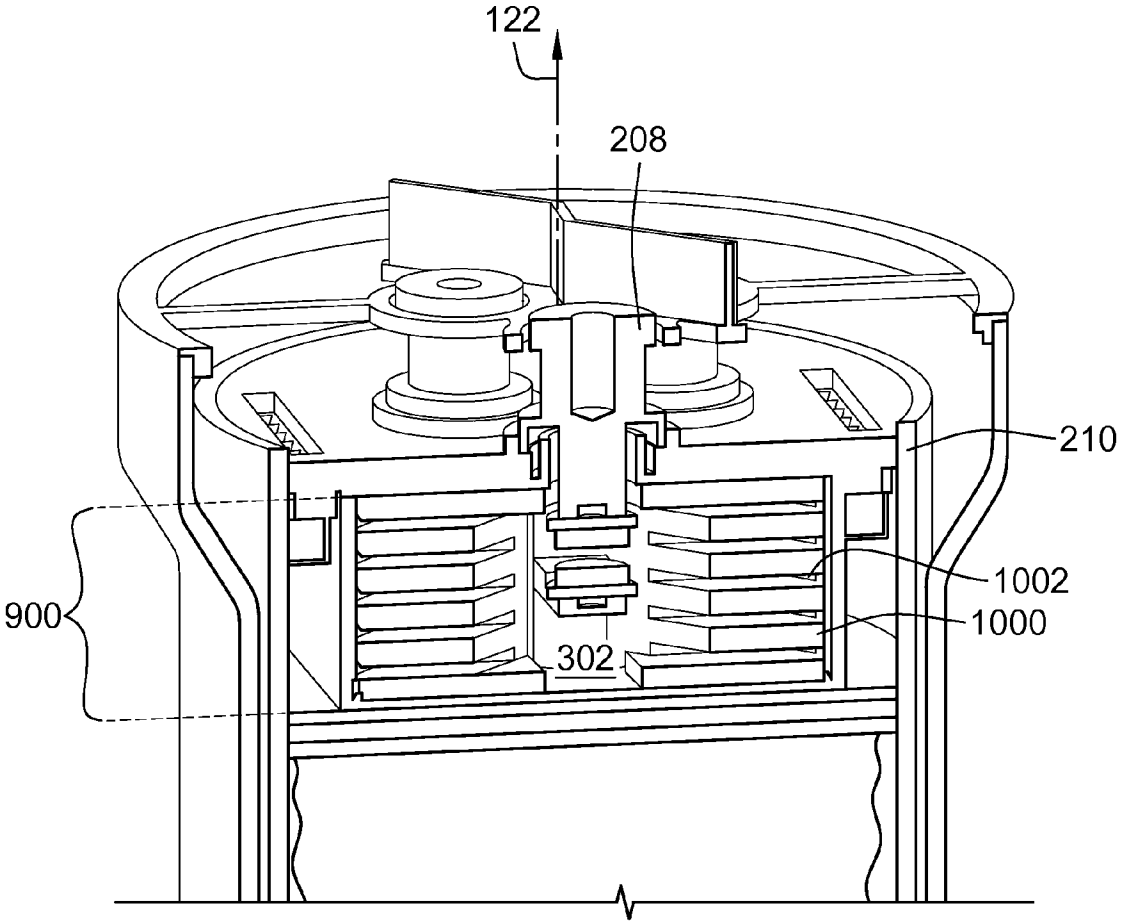
FIG. 10 is a cross-sectional view of the contactor assembly shown in FIG. 1 along line 10-10 as shown in FIG. 9.

FIG. 9 is a cross-sectional view of the contactor assembly 102 along line A-A in accordance with another embodiment of the present disclosure. FIG. 10 is a cross-sectional view of the contactor assembly 102 along line 10-10 as shown in FIG. 9. In the embodiment shown in FIGS. 9 and 10, the contactor assembly 102 includes arc chutes 900 in the interior chamber 308 of the inner housing 210. The arc chutes 900 are provided in the blowout pockets 316-322. The arc chutes 900 include several plates 1000 (shown in FIG. 10) disposed above one another in directions oriented parallel to the longitudinal axis 122. As shown in FIG. 10, the plates 1000 are at least partially separated from one another such that air gaps 1002 are disposed between vertically adjacent plates 1000. The plates 1000 may be formed from a non-conductive or dielectric material, such as a ceramic or polymer. Alternatively, the plates 1000 may be metallic. The plates 1000 assist in dissipating electric arcs radiating from the arc contacts 206, 208. For example, the plates 1000 may dissipate the energy of the electric arcs emanating from the arc contacts 206, 208 and directed into the blowout pockets 316-322 by the magnets 424. The arc chutes 900 may dissipate the arcs by cooling the temperature of the atmosphere in the blowout pockets 316-322 and/or of the arc when the arc propagates into the blowout pockets 316-322. Cooling the atmosphere and/or arc temperature may disperse the arc faster than blowout pockets 316-322 that do not include the arc chutes 900.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A contactor assembly adapted for switching power to a circuit having a power source, the contactor assembly comprising:

a housing defining an interior compartment and including internal chamber walls that laterally extend within the interior compartment to define a protection chamber;

current carrying contacts disposed in the protection chamber of the housing, the current carrying contacts including conductive bodies that protrude from the housing and are configured to close the circuit; and arc contacts disposed in the housing outside of the protection chamber, the arc contacts including conductive bodies that protrude from the housing and are configured to close the circuit, wherein the internal chamber walls of the housing prevent material that is expelled from one or more of the arc contacts when an electric arc emanates from the one or more of the arc contacts from contaminating one or more of the current carrying contacts.

2. The contactor assembly of claim 1, wherein the housing includes opposing transverse perimeter walls on opposite sides of the interior compartment with the arc contacts disposed on opposite sides of the protection chamber and between the transverse perimeter walls, each of the arc contacts separated from the transverse perimeter walls by blowout pockets on opposite sides of the arc contact.

3. The contactor assembly of claim 2, wherein the housing includes opposing lateral perimeter walls on opposite sides of the interior compartment interconnecting the transverse perimeter walls, the blowout pockets disposed between the chamber walls and the transverse perimeter walls.

4. The contactor assembly of claim 2, wherein the blowout pockets provide space on opposite sides of the arc contacts to dissipate the electric arc extending from one or more of the arc contacts.

5. The contactor assembly of claim 2, further comprising magnets inducing magnetic fields across the arc contacts, the magnetic fields directing the electric arc extending from one or more of the arc contacts into one or more of the blowout pockets.

6. The contactor assembly of claim 2, further comprising an arc chute disposed in one or more of the blowout pockets.

7. The contactor assembly of claim 1, wherein the housing includes opposing transverse perimeter walls on opposite sides of the interior compartment, the chamber walls extending from each of the transverse perimeter walls toward the opposite transverse perimeter wall with the carry contacts disposed between the chamber walls.

8. The contactor assembly of claim 1, wherein the internal chamber walls include first and second sets of chamber walls and the housing includes opposing first and second transverse perimeter walls on opposite sides of the interior compartment, the chamber walls of the first set extending from the first transverse perimeter wall toward the second transverse perimeter wall and the chamber walls of the second set extending from the second transverse perimeter wall toward the first transverse perimeter wall.

9. The contactor assembly of claim 1, wherein the interior chamber of the housing is bounded by opposing upper and lower walls, opposing transverse perimeter walls, and opposing lateral perimeter walls, the transverse perimeter walls and lateral perimeter walls intersecting one another and extending from the upper wall to the lower wall.

10. The contactor assembly of claim 1, wherein the housing includes arc dissipation chambers disposed on opposite sides of the protection chamber with each of the arc contacts located in a different arc dissipation chamber.

11. The contactor assembly of claim 1, further comprising an actuator subassembly disposed between one of the ends of the housing and the interior compartment, the actuator subassembly comprising a first coupling member that mates with and electrically interconnects the carry contacts and a second coupling member that mates with and electrically interconnects the are contacts, wherein the actuator moves along the longitudinal axis to electrically couple the arc contacts prior to electrically coupling the carry contacts.

12. The contactor assembly of claim 11, wherein the current carrying contacts and the arc contacts have conductive pads that mate with the first and second coupling members, respectively, the conductive pads of the current carrying contacts including a silver alloy, the conductive pads of the arc contacts including a refractory metal.

13. A contactor assembly comprising:

a housing interior compartment having opposing transverse perimeter walls and opposing internal chamber walls extending from each of the transverse perimeter walls;

current carrying contacts disposed in the interior compartment between the chamber walls in the housing, the current carrying contacts including conductive bodies that protrude from the housing to close a circuit having a power source, the current carrying contacts configured to be electrically interconnected to close the circuit;

arc contacts disposed in the interior compartment between the transverse perimeter walls and separated from the current carrying contacts by the chamber walls, each of the arc contacts separated from the transverse perimeter walls by blowout pockets of the interior compartment, the arc contacts including conductive bodies that are configured to be electrically interconnected to close the circuit; and a magnet disposed within the housing, the magnet imparting a magnetic flux across one or more of the arc contacts, wherein the chamber walls prevent an electric arc emanating from one or more of the arc contacts from extending to the current carrying contacts and the magnet directs the electric arc into the blowout pockets and away from one or more of the current carrying contacts when electric current is supplied by the circuit across the arc contacts.

14. The contactor assembly of claim 13, wherein each of the arc contacts are separated from the transverse perimeter walls by the blowout pockets on opposite sides of the arc contact.

15. The contactor assembly of claim 13, wherein the housing includes opposing lateral perimeter walls interconnecting the transverse perimeter walls, the blowout pockets disposed between the chamber walls and the lateral perimeter walls.

16. The contactor assembly of claim 13, wherein the internal chamber walls of the housing prevent the electric arc from extending between the arc contacts and one or more of the current carrying contacts when electric current is supplied by the power source across the arc contacts.

17. The contactor assembly of claim 13, further comprising an arc chute disposed in one or more of the blowout pockets.

18. The contactor assembly of claim 13, wherein the chamber walls extend to outer edges, the outer edges of the chamber walls extending from one of the transverse perimeter walls separated from the outer edges of the chamber walls extending from another of the transverse perimeter walls by a gap.

19. The contactor assembly of claim 13, wherein the internal chamber walls include first and second sets of chamber walls and the housing includes opposing first and second transverse perimeter walls on opposite sides of the interior compartment, the chamber walls of the first set extending from the first transverse perimeter wall toward the second transverse perimeter wall and the chamber walls of the second set extending from the second transverse perimeter wall toward the first transverse perimeter wall.

20. The contactor assembly of claim 13, further comprising an actuator subassembly disposed between one of the ends of the housing and the interior compartment, the actuator subassembly comprising a first coupling member that mates with and electrically interconnects the current carrying contacts and a second coupling member that mates with and electrically interconnects the arc contacts, wherein the actuator moves along the longitudinal axis to electrically couple the arc contacts prior to electrically coupling the current carrying contacts.

* * * * *